United States Patent [19]

Brown

[11] 3,964,750

[45] June 22, 1976

[54] JIGSAW PUZZLE PAINT SET

[75] Inventor: Lyman J. Brown, LaGrange, Ill.

[73] Assignee: Bates Printing Specialties, Inc., Cicero, Ill.

[22] Filed: July 3, 1975

[21] Appl. No.: 592,928

Related U.S. Application Data

[62] Division of Ser. No. 521,949, Nov. 8, 1974, abandoned.

[52] U.S. Cl. ..... 273/157 R; 35/26

[51] Int. Cl.[2] ..... A63F 9/10

[58] Field of Search ..... 273/157 R; 35/26

[56] References Cited

UNITED STATES PATENTS

| | | | |
|---|---|---|---|
| 1,225,071 | 5/1917 | Spotswood | 273/157 R |

FOREIGN PATENTS OR APPLICATIONS

| | | | |
|---|---|---|---|
| 466,072 | 10/1928 | Germany | 35/26 |
| 1,186,189 | 4/1970 | United Kingdom | 273/157 R |
| 4,796 | 1905 | United Kingdom | 35/26 |

*Primary Examiner*—Anton O. Oeschsle
*Attorney, Agent, or Firm*—Kinzer, Plyer, Dorn & McEachran

[57] ABSTRACT

A die-cut jigsaw puzzle particularly adapted for distribution as premium items. As disclosed herein it is an educational toy formed from an elongated rectangular cardboard blank. The blank is divided by laterally extending perforated lines into three generally equal sized panels, including a center panel with an end panel on each side. One of the end panels has a jigsaw puzzle die-cut therein with the puzzle being surrounded by an uncut peripheral border of the panel. The jigsaw puzzle containing panel is folded over about a perforated line and adhered to the center panel by an adhesive which is applied to the peripheral border of the panel. An aperture formed in the center panel is aligned with the jigsaw puzzle portion of the end panel and is sufficiently large to permit a child to insert his finger through the aperture to remove the pieces of the jigsaw puzzle from the panel. The other end panel contains a number of water soluble paints which may be of different colors. A portion of the paint containing end panel is subdivided by perforations into removable elongated strips of cardboard which can be used as paint brushes. The paint containing end panel is releasably adhesively secured to the jigsaw puzzle end panel when the item is in its folded condition. A design is printed on the jigsaw puzzle panel.

4 Claims, 4 Drawing Figures

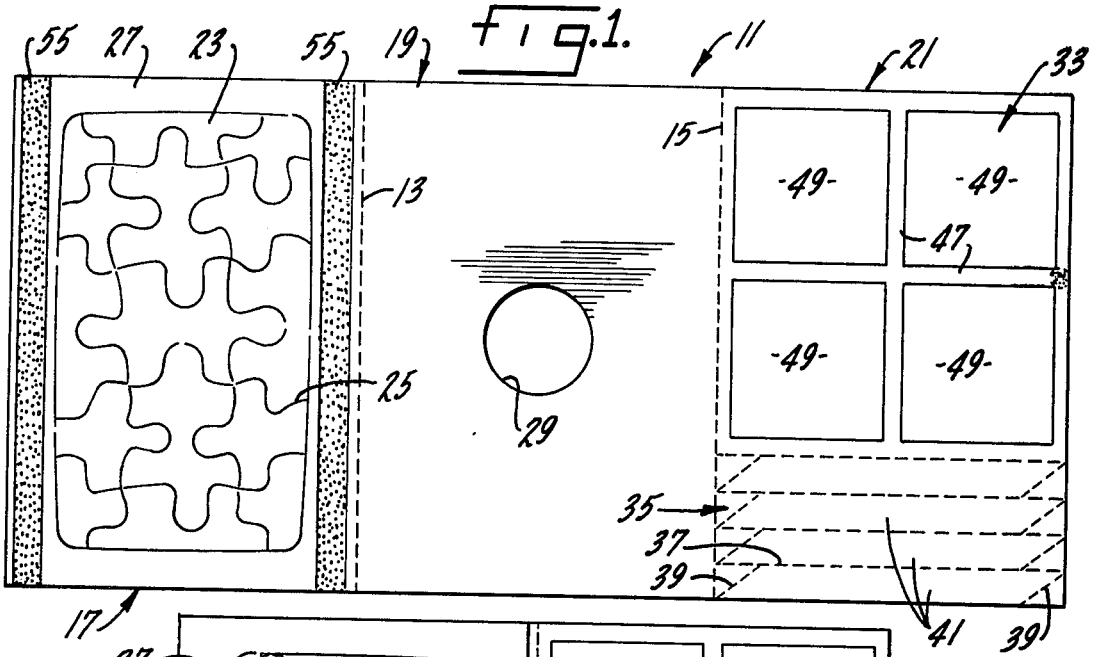
fig.1.
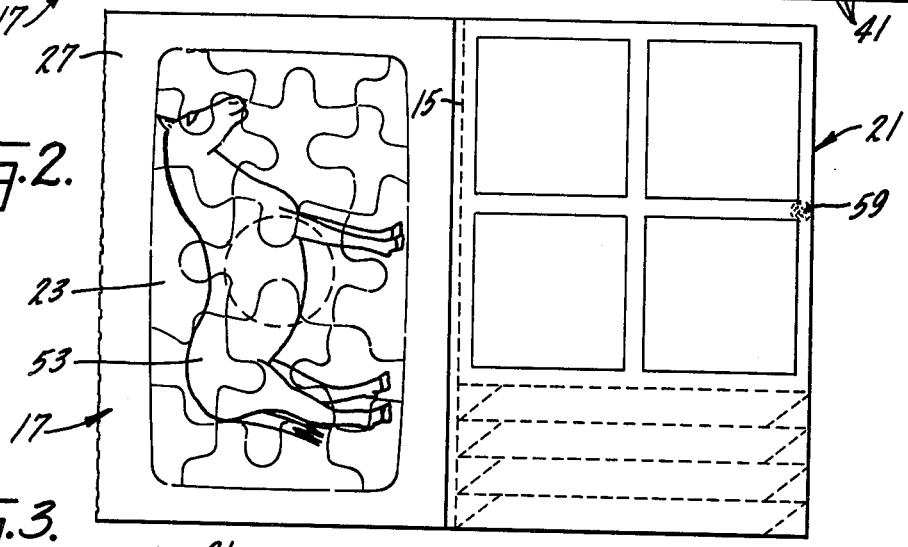
fig.2.
fig.3.
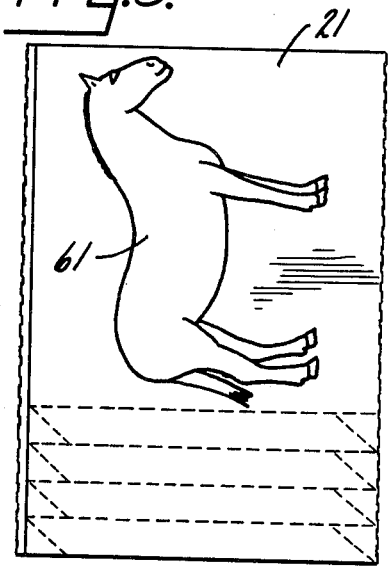
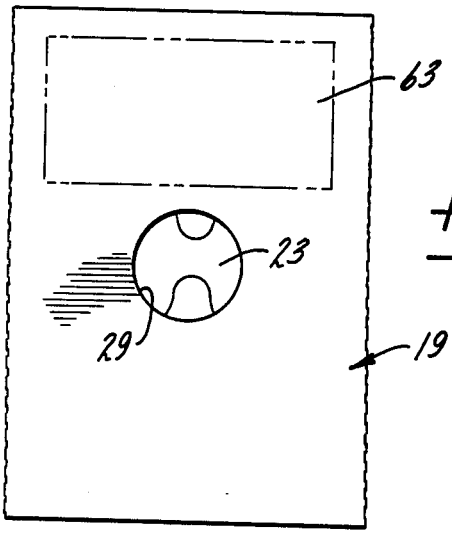
fig.4.

JIGSAW PUZZLE PAINT SET

This is a division of application Ser. No. 521,949, filed Nov. 8, 1974, and now abandoned.

SUMMARY OF THE INVENTION

This invention is concerned with a frame enclosed die-cut jigsaw puzzle and particularly with one that can be used as a premium item in food packages.

An object of this invention is a framed jigsaw puzzle which can be obtained by die-cutting a single thickness of carbdboard.

Another object is a paint containing educational toy which can be inserted in food packages without requiring a separate wrapping.

Another object is a framed jigsaw puzzle which is die-cut and can easily be removed from the frame, yet will not fall out prematurely.

Another object is a self-contained jigsaw puzzle and painting kit.

Other objects may be found in the following description, claims and drawings.

BRIEF DESCRIPTION OF THE DRAWINGS

FIG. 1 is a plan view of one side of a die-cut blank for an educational toy;

FIG. 2 is a plan view of the blank with one end panel folded over and adhered to the center panel of the blank;

FIG. 3 is a front plan view of the blank completely folded and;

FIG. 4 is a back plan view of the completely folded blank.

DESCRIPTION OF THE PREFERRED EMBODIMENTS

One form of an educational toy embodying the novel features of this invention is shown in FIGS. 1 to 4 of the drawings and includes an elongated rectangular cardboard blank 11 which is divided by laterally extending lines of weakness 13 and 15 into end, center and end panels 17, 19 and 21 respectively, of equal area. The line of weakness 13 and 15 in this embodiment of the invention are formed by perforations, and this is the preferred method of forming the lines of weakness, although it should be understood and appreciated that other well known methods may be used. The interior of end panel 17 is die-cut to form a jigsaw puzzle 23. Nicks are formed in the die which cuts the jigsaw puzzle to leave interruptions in the cut lines 25 so that the pieces of the puzzle will remain in the panel until they are intended to be removed. The jigsaw puzzle is centered in the end panel 17 leaving a peripheral border or frame 27 surrounding the puzzle.

An aperture 29 is formed, preferably by die-cutting, in the center of panel 19. In this example, the aperture is circular and approximately three-quarters of an inch in diameter so that a child's finger may easily pass therethrough.

Panel 21 is divided into a palette section 33 and a brush section 35. Spaced longitudinally extending perforations 37 and 39 divide the brush section of end panel 21 into a plurality of elongated strips 41 which may be removed from the brush section to be used as paint brushes. Printed indicia may be applied to the brush section and generally aligned with the lines of perforation to indicate that these strips of cardboard are to be used as paint brushes. This indicia can be in the nature of lettering and shade lines indicating the brush tips.

The palette sections 33 of the panel 31 are divided by printed indicia 47 into a series of squares, in this case four, each containing a water soluble color 49. Suitable water soluble colors are sold by the Richardson Ink Co. of Niles, Ill. and designated as dry offset, water soluble inks. These inks are non-toxic and some, depending upon the particular color, contain food dyes.

The opposite side of blank 11, as shown in FIG. 2, has an indicia 53 printed on the jigsaw puzzle portion 23 of the end panel 17. This indicia forms a picture to which the colors 49 may be applied using the elongated strip-like brushes 41. An adhesive 55 is applied to either the peripheral border portion 27 of the panel 17 or the corresponding portion of the panel 19 so that when the panel 17 is folded over line of weakness 15 against panel 19, the adhesive will hold the panels together but will not contact the jigsaw portion 23 of panel 17. A small amount of an adhesive 59 may be applied to the peripheral border 27 of the panel 17 outside of the jigsaw puzzle or, as shown in FIG. 2, to the outer edge of panel 21, to releasably adhere panel 21 to panel 17 when the panels are folded over the line of weakness 15. Indicia 61, which may be a design identical to design 53, is formed on the back side of panel 21, that is the side opposite to that containing the colors 49. Indicia 63, which may be in the nature of instructions, can be applied to the rear of panel 19.

The adhesive 59 is easily broken so that the educational toy can be opened from its fully closed position, shown in FIGS. 3 and 4, in which it is enclosed as a premium item in the typical food container, so that the jigsaw puzzle 23 and its design 53 are visible to the user and so that the water soluble colors 49 and brushes 41 are also available to the user. The strips 41 are separated from the brush section 35 of the panel 21 by tearing the brushes along their perforations 37 and 39. The brushes may then be dipped into water. The wet brushes can be rubbed against the water soluble colors 49 to pick up the colors. The colors are then applied to the portions of the jigsaw puzzle 23 in accordance with the design of the indicia 53. When the jigsaw puzzle has been completely colored it can be removed from the peripheral border 27 which forms a frame for the jigsaw puzzle by inserting a finger through the aperture 29 in the center panel 19 thereby pushing the jigsaw pieces out of the border. The pieces of the jigsaw puzzle may now be repositioned in the frame 27 to reconstruct the puzzle 23 and the design 53.

I claim:

1. An educational toy including:

an elongated rectangular paperboard blank divided by laterally extending lines of weakness into three generally equal sized panels, including a center panel with an end panel on each side thereof, with said end panels being foldable over said center panel, one of the end panels having a jigsaw puzzle die-cut therein with said puzzle being at least partially surrounded by an uncut peripheral border of said panel, said jigsaw puzzle containing panel being folded over and adhered to said center panel by an adhesive applied to said panels in the area of said peripheral border, an aperture formed in said center panel and aligned with said jigsaw puzzle portion of said end panel when said panels are folded over and adhered together, a plurality of water soluble color containing areas formed on said other end panel, and a portion of said color containing end panel subdivided by perforations into removable elongated strips of paperboard.

2. The educational toy of claim 1 in which said color containing end panel is folded over and releasably adhesively secured to said jigsaw puzzle end panel.

3. The educational toy of claim 1 in which said aperture is sufficiently large to permit passage of a child's finger.

4. The educational toy of claim 1 in which indicia in the form of a design is printed on the side of said jigsaw puzzle facing away from said aperture containing panel.

* * * * *